United States Patent [19]

Lemarquand et al.

[11] Patent Number: 4,990,875

[45] Date of Patent: Feb. 5, 1991

[54] SWITCHING APPARATUS WITH CONTACTS CONTROLLABLE BY AN ELECTROMAGNET

[75] Inventors: Pierre Lemarquand, Velars/Ouche; Christian Pichard, Asnieres Les Dijon, both of France

[73] Assignee: La Telemecanique Electrique, France

[21] Appl. No.: 318,289

[22] Filed: Mar. 3, 1989

[30] Foreign Application Priority Data

Mar. 4, 1988 [FR] France ..... 88 02751

[51] Int. Cl.[5] ..... H01H 9/02

[52] U.S. Cl. ..... 335/131; 335/14; 335/20

[58] Field of Search ..... 335/6, 16, 14, 20, 132, 335/131

[56] References Cited

U.S. PATENT DOCUMENTS 4,470,028 9/1984 Vayre et al. ..... 335/6

4,855,698 8/1989 Cohen et al. ..... 335/20

*Primary Examiner*—Leo P. Picard

*Assistant Examiner*—Lincoln Donovan

*Attorney, Agent, or Firm*—William A. Drucker

[57] ABSTRACT

An electromechanical switching apparatus is provided, particularly a protection apparatus, whose contacts are controllable by means of a local of remote controlled electromagnet. The electromagnet is of the monostable type and an engagement mechanism is associated with a mobile assembly connected to the mobile armature. A two position switch accessible from outside the case enables and, respectively, disables the operation of the engagement mechanism. An auxiliary closure piece is provided for manual closure of the contacts.

11 Claims, 5 Drawing Sheets

SWITCHING APPARATUS WITH CONTACTS CONTROLLABLE BY AN ELECTROMAGNET

BACKGROUND OF THE INVENTION switching apparatus whose contacts are controllable by a local or remote controlled electromagnet, more particularly a protection apparatus in which the contacts are further secured to excess current trips. Such apparatus are well known and they have a contactor function, if required, combined with a breaker function.

They comprise for example:

at least one pole with separable contacts, a magnetic trip and/or a thermal trip associated with pole for controlling the opening of the contacts via a tripping mechanism, at least one manual control button disposed on a front face of the case and acting on the tripping mechanism for opening and closing the contacts, an electromagnet causing opening and closing of the contacts in response to the energization and to the deenergization of its coil, via a mobile assembly coupled to its armature, whereas a return system urges the armature towards a return position.

When the coil of the electromagnet is supplied with power, a holding current remains applied to this coil and the contacts of the apparatus remain in a stable closed or open state unless an excess current fault has been detected by the tripping devices-until the supply to the coil is interrupted. The breaker apparatus thus operates in "contactor" mode.

It would be desirable to use the same apparatus for providing a "remote controlled breaker" mode control, i.e. with the coil at present fed with current pulses, the contacts of the apparatus should close and open alternately at each pulse, while remaining maintained in their position until the next pulse.

SUMMARY OF THE INVENTION

The object of the present invention is to provide, in a switching apparatus of the above described type, a selective "contactor" mode or "remote controlled breaker" mode with the same electromagnet and using components taking up little space and very simple to produce and assemble.

Its purpose is to permit ready auxiliary manual control for closing the contacts of the switching apparatus by facilitating, as required, automatic return or locking of this control.

Another aim is to reduce the energy of the return system to be overcome for actuating the contacts and, if required, to combine the return system and the auxiliary manual closure control.

According to the invention, the electromagnet is of the monostable type and an engagement mechanism is associated with the mobile assembly for locking it in one of its positions against the force exerted by the return system, whereas a two position switch accessible from outside the case enables and, respectively, disables the operation of the engagement mechanism.

The result is that, using very simple means, the switching apparatus can be used in contactor mode or in remote controlled breaker mode. When this apparatus is a protection apparatus, its size is small, particularly when the electromagnet, the mobile assembly and the engagement mechanism are housed opposite the magnetic and thermal trips with respect to a transversely disposed tripping mechanism.

The return system preferably has a spring loaded pivoting lever engaged with a bearing surface of the slider, the return system being adapted for transmitting to the slider a force which decreases in the closure direction of the armature of the electromagnet, i.e. which decreases when the contacts close and impact.

An auxiliary closure piece is advantageously provided for the contacts, accessible through the front face of the apparatus and adapted to take up two positions for releasing or, respectively, locking the pivoting lever. This piece may be urged by a spring towards its inactive position or be locked in its active position.

BRIEF DESCRIPTION OF THE DRAWINGS

Embodiments of the invention will be described hereafter by way of non limitative examples, with reference to the accompanying drawings in which.

DESCRIPTION OF THE PREFERRED EMBODIMENTS

Figure 1:
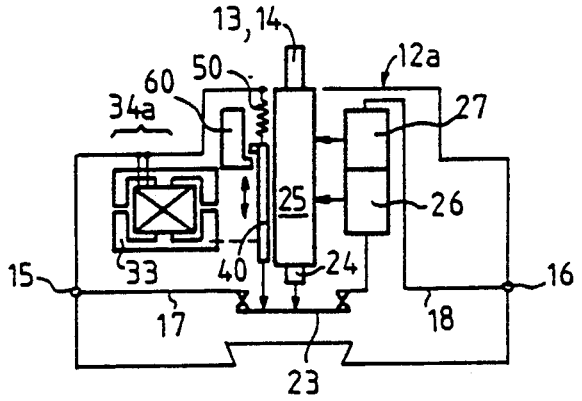
FIG. 1 is a diagram illustrating a protective switching apparatus in accordance with the invention.
Figure 2:
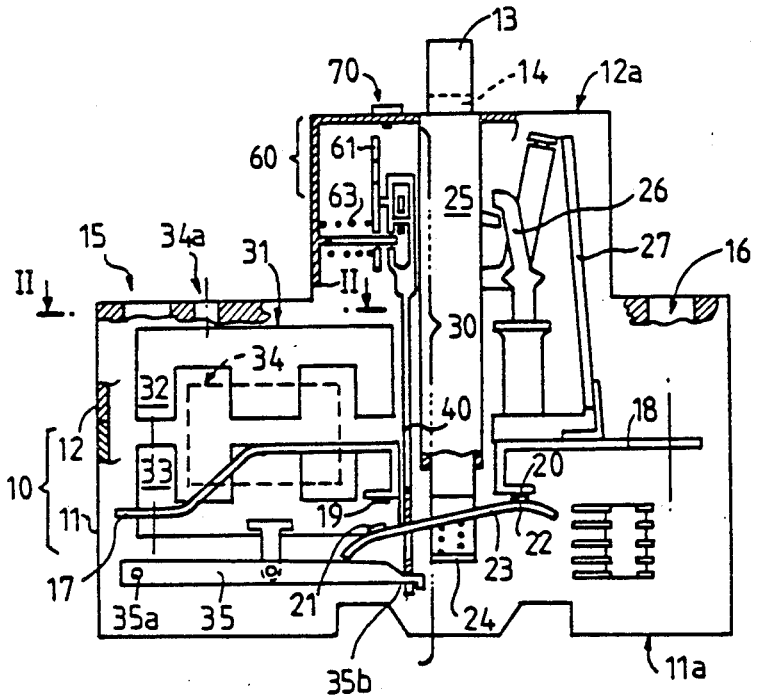
FIG. 2 is a schematic elevational view of one embodiment of the protective switching apparatus.
Figure 3:
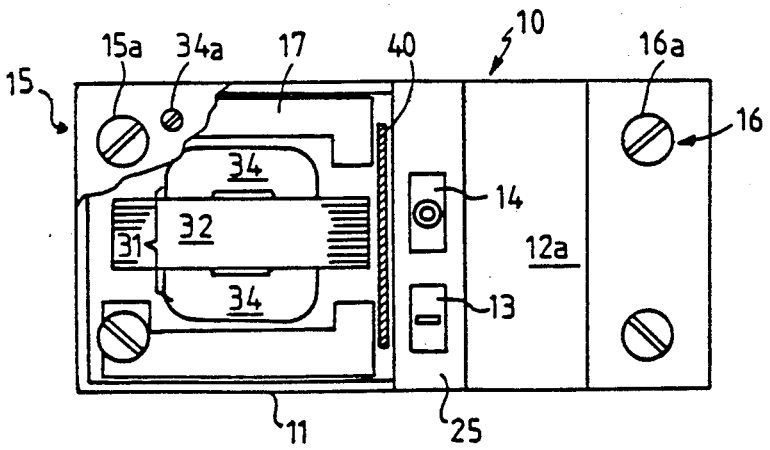
FIG. 3 is a top view of the apparatus of FIG. 2, the cover being removed, in partial section through II—II

The protective switching apparatus illustrated in FIGS. 1, 2 and 3 comprises a case 10 formed of a base 11 and a cover 12. On the front face 12*a* of the cover are situated an ON button 13 and an OFF button 14. Opposite the front face 12*a*, the apparatus has a rear face 11*a* adapted for fixing to a support.

The apparatus shown is bipolar, but may of course be unipolar, tri- or tetrapolar. . . Each pole comprises two power terminals 15, 16 with screws 15a, 16*a* each connected via a contact piece 17, 18 to a fixed contact 19, 20. The respective contacts 21, 22 of a contact bridge 23 cooperate with the fixed contacts so as to give rise to a double break.

The contact bridge 23 is connected to a contact holder 24. The contact holder is movable by a tripping mechanism 25 controlled either manually by the ON 13 and OFF 14 buttons or automatically in response to an excess current by a magnetic trip 26 or a thermal trip 27 of the pole considered or of an adjacent pole.

The tripping mechanism 25 is housed in a compartment disposed transversely and orthogonally to the front 12*a* and rear 11*a* faces of the apparatus. The contact bridge is mounted in the contact holder 24 by means of springs 28, the crushing of which, on closure, provides the contact pressure.

In addition, the contact bridge 23 is secured directly to a mobile assembly 30 coupled to an electric control electromagnet 31. Electromagnet 31 has a fixed magnetic circuit 32 and a mobile armature 33, as well as an energization coil 34 wound on a carcass which is mounted on a central leg of the magnetic circuit and of the armature Screw terminals 34*a* are provided for supplying the coil with power. The electromagnet is of the monostable type, i.e. the armature can only be held against the fixed magnetic circuit by means of a holding current. A monostable electromagnet with plunger core could also be used.

The mobile armature 33 is coupled to a change of direction lever 35, one end 35*a* of which is mounted for pivoting and the other end 35*b* of which is connected to a slider 40 of the mobile assembly 30. Slider 40 is flat in shape and is adapted for sliding between the bent end of the contact piece 17 and the compartment of the tripping mechanism 25. Because of the lever, the slider travels over a distance which is a multiple of that of the armature.

Figure 15:
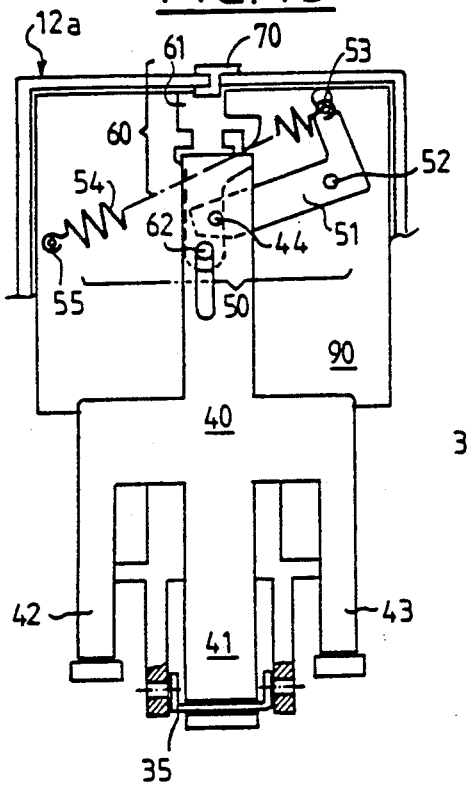
FIG. 15 is a side view of a sub-assembly comprising the electromagnet, the mobile assembly, the return system and the engagement mechanism.
Figure 16:
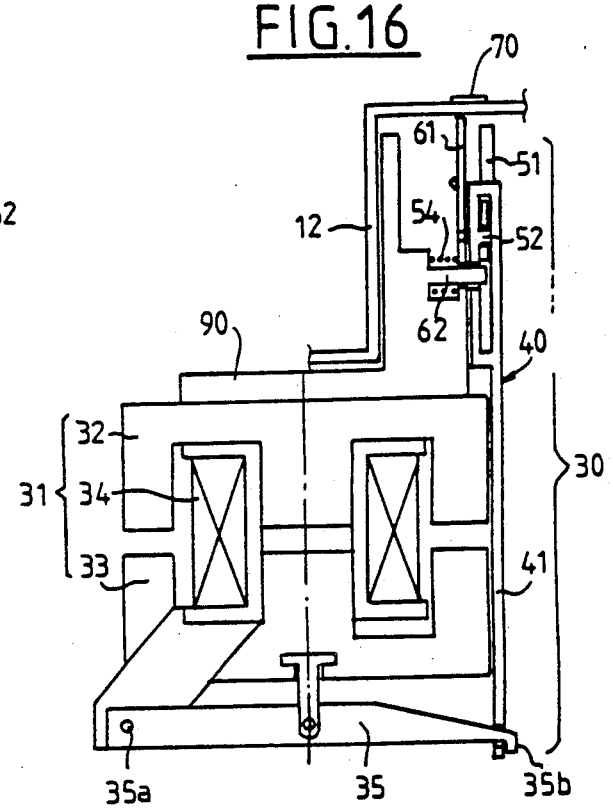
FIGS. 16, 17 show the sub-assembly in elevation in the open and respectively closed positions of the contacts.
Figure 17:
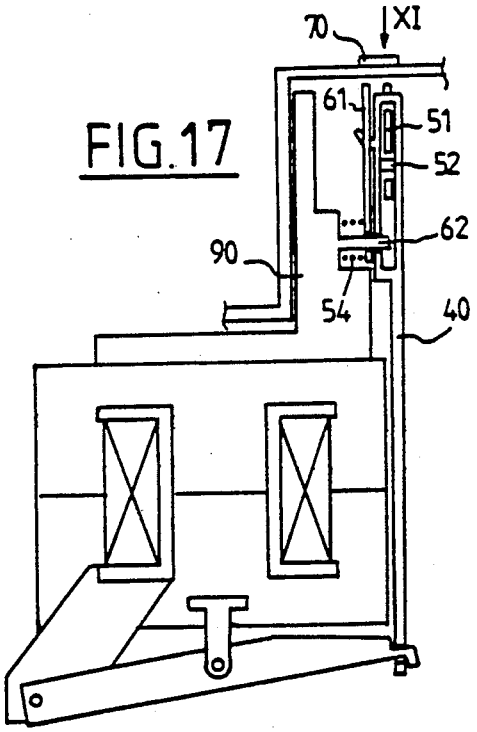
Figure 18:
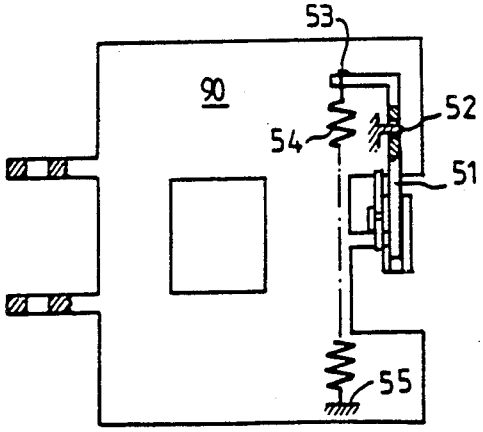
FIG. 18 is a view of the sub-assembly along arrow XI of FIG. 17.

Slider 40 is movable between a raised position in which it does not act on the contact bridges and a lowered position in which it causes the contact bridges to pivot. A single break then occurs, by opening of contact 21, with pivoting of the contact bridge in the zone of contact 22. The slider 40 has, in its lower part, a central leg 41 (see FIG. 15) into a slit of which one end of lever 35 penetrates and lateral fingers 42, 43 in number equal to that of the poles and each of which cooperates with a contact bridge of a respective pole.

A return system 50 and an engagement mechanism 60 are associated with slider 40.

The return system 50 comprises a cranked pivoting lever 51 mounted on a fixed shaft 52 and in engagement through a circular or oblong orifice provided at its lower end with a tenon 44 situated at the upper part of slider 40. At a point 53 situated at its upper end, lever 51 is urged in an anti-clockwise direction by a spring 54 anchored to a fixed point 55. The position and the characteristics of elements 50–55 are determined so that the return system urges slider 40 with a force which decreases with closure of armature 33 of the magnetic circuit, i.e. which decreases when the contacts close and impact. It should be noted that the force of the contact pressure springs also decreases during closing of the armature.

This negative slope return system has the advantage of appreciably reducing the energy to be expended for closing the contacts.

Figure 5:
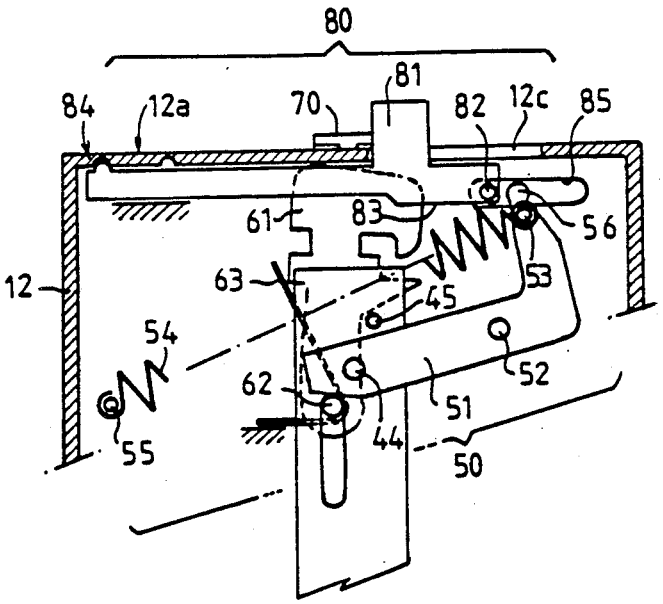
FIGS. 5, 6 show schematically the mechanism for engaging the slider and the return system in respective open and closed positions of the contacts.
Figure 7:
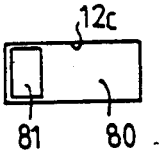
FIGS. 7, 8 show the respective positions of the button of the auxiliary closure piece.
Figure 8:
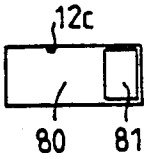
Figure 6:
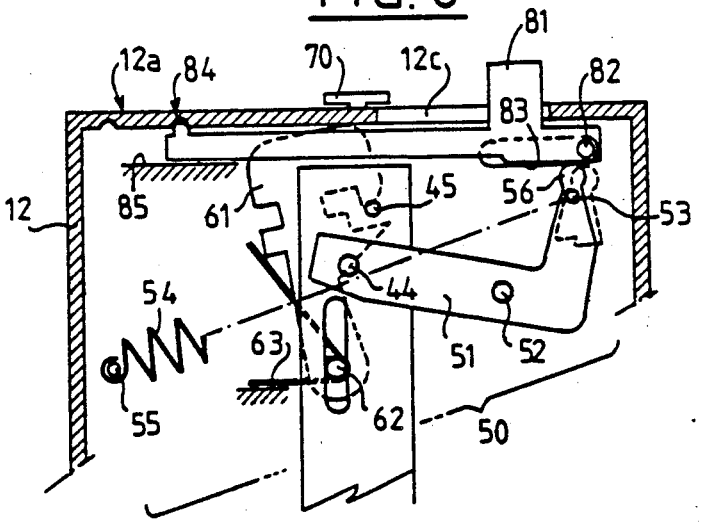

The engagement mechanism 60 is of the follower type and has a pivoting bolt 61 mounted on a pivot 62 and urged by a spring 63 in a clockwise direction (FIGS. 5, 6; 10, 11 and 15). Bolt 61 is designed for receiving in a housing 64 a pin 45 belonging to slider 40. Ramps 66*a*, 66*b* operating when the slider moves up and a transverse ramp 67 operating when the slider moves down are provided on bolt 61. The latter is a stamped and bent part.

Figure 4:
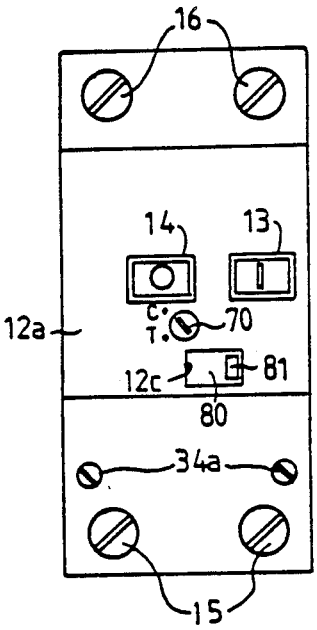
FIG. 4 is a view of the front face of the apparatus in a first embodiment in the form of breaker contactor/-remote controlled breaker.
Figure 22:
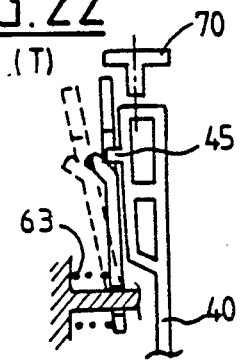
FIGS. 22, 23 show the bolt in a side view in the engagement position and respectively in the retracted position.
Figure 23:
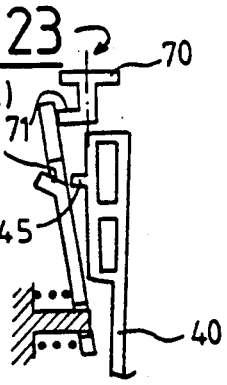

Bolt 61 may be slanted transversely so as to let the slider pass freely (see FIGS. 22, 23). The bolt pivots then about an axis orthogonal to that of the pivot and against a resilient force provided by a helical part of spring 63 or by any other spring. The driving force for the pivoting movement is either pin 45 when it is situated in housing 64 and when the slider moves down (see FIG. 22; broken line position) or a pivoting switch 70 with cam 71 which passes through an opening 12*b* in the front face 12*a* of the case (see FIG. 23). Switch 70 may be actuated by a tool for occupying two positions, indicated by C (contactor) and T (remote controlled breaker) in FIG. 4.

In position T of FIG. 22, which corresponds to FIGS. 5, 6, cam 71 does not urge the bolt 61. In position C, which corresponds to FIG. 23, cam 71 pushes bolt 61 back.

As can be seen in FIGS. 4 to 8, a manual auxiliary closure piece 80 is provided having a button or grip 81 accessible through an opening 12*c* in the front face 12*a* of the case of the apparatus. In the present example, the piece is mounted for sliding between a rest position (FIG. 5) and a working position (FIG. 6). When piece 80 is moved manually from its rest position to its working position it causes pivoting lever 51 to pivot in a clockwise direction by means of a pin 82 or a ramp cooperating with an element or a bearing surface such as the head 56 of lever 51. In order to hold lever 51 pivoted against the force of spring 54, piece 80 has a retaining surface 83 for head 56. Notches and projections 84 are formed in piece 80 and in the case for holding the manual closure piece 80 in its rest and working positions. Piece 80 is guided by slides such as 85.

Figure 9:
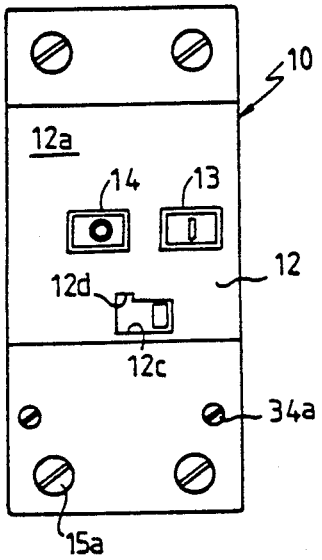
FIGS. 9, 10, 11 and 12, 13, 14 show in the same way as FIGS. 4, 5, 6 and 7, 8 a second embodiment in the form of a breaker-contactor with lockable closure.

In the embodiment illustrated in FIGS. 9. 10. 11 and 12, 13, no engagement mechanism 60 or switch 70 is provided, which means that the electric control of the apparatus will always be in "contactor" mode, i.e. closure of the contacts will only be maintained by supplying the coil with a holding current.

Figure 10:
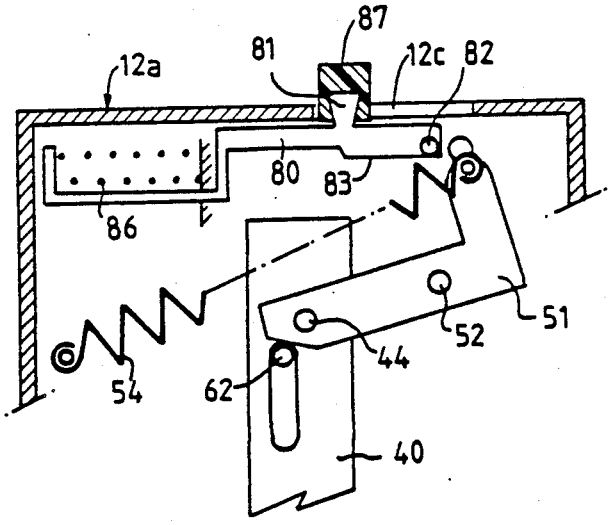
Figure 12:
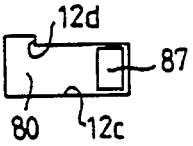
Figure 13:
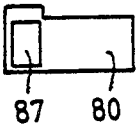
Figure 14:
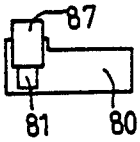
Figure 11:
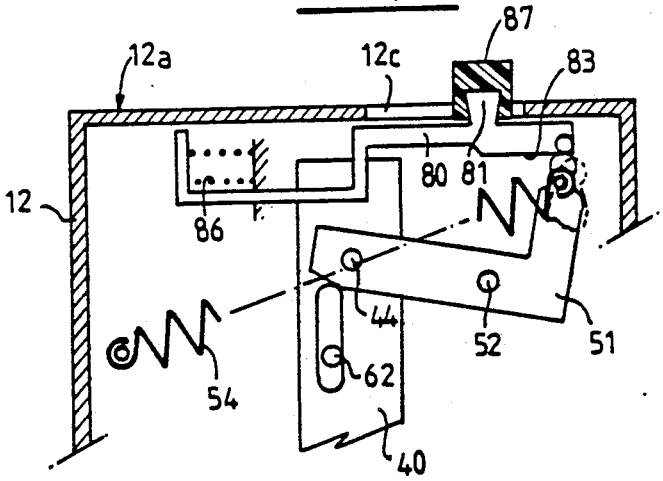

The manual auxiliary closure piece is urged to its rest position by a spring 86, and its button 81 is capped by a cursor 87, whereas the opening 12*a* of the case has, at its left hand end, a step 12*d*. Cursor 87 may slide over button 81 perpendicularly to the direction of movement of piece 80 and engage in the step for locking the piece in its working position shown in FIG. 11 which corresponds to closing of the contacts. In the position shown in FIGS. 10 and 12, piece 80 is at rest and slider 40 may then freely move up and down depending on whether the coil is supplied with power or not. In the position shown in FIGS. 11 and 13, piece 80 has been placed in "manual operation" but it is not locked and as soon as the electromagnet is supplied with power again, piece 80 escapes from the pressure of the pivoting lever and comes back to its rest position shown in FIG. 10 under the effect of spring 86. In the position shown in FIGS. 11 and 14, piece 80 is placed in "manual operation", but it is locked in this active position, and the contacts of the apparatus can only be opened-apart from a magnetic or thermal fault-by the voluntary return of cursor 87 over button 81. It goes without saying that all other elements for blocking or locking button 81 may be used instead of those which have been described.

FIGS. 15 to 18 illustrate the sub-assembly formed of the electromagnet 31, slider 40, the associated return system 50 and the engagement mechanism 60. The different parts of the sub-assembly are mounted on an insulating support 90 which forms the carcass of the coil, the fixed bearing point of spring 54, the shaft of bolt 61, etc...

Figure 19:
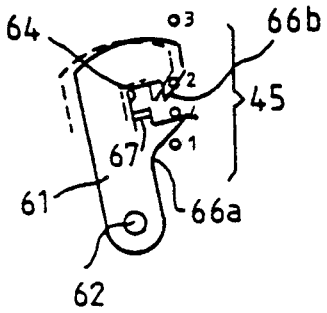
FIGS. 19, 20, 21 show different positions of the bolt of the engagement mechanism.
Figure 20:
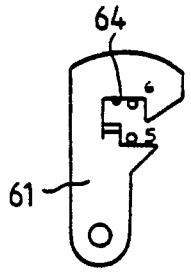
Figure 21:
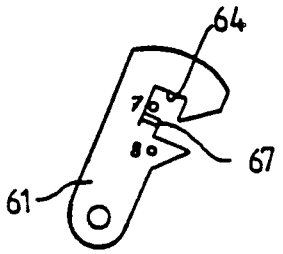

FIGS. 19, 20, 21 show different positions of bolt 61. FIG. 19 shows the beginning of lifting of slider 40; the bolt is urged in a clockwise direction by spring 63. It is pushed back in an anti-clockwise direction towards the position shown with broken lines when pin 45 (position 1) is applied on the lower ramp 66*a*, and then jumps on to the upper ramp 66*b* (position 2) and comes rapidly back to position 3 then 4 before engagement in housing 64. The slider is then held in a raised position and the contacts closed-until the next current pulse applied to the coil. In this case, pin 45 passes from position 4 to position 5 and spring 63 brings the bolt back in a clockwise direction to the position shown in FIG. 21 in which pin 45 is allowed to move down by ramp 67. The engagement mechanism described may of course be replaced by any other equivalent mechanism conferring on the electromagnetic control sub-assembly a bistable character with simplicity and in a small space.

FIG. 22 shows pivoting of the bolt to the position shown with broken lines under the effect of pin 45 when the latter passes from position 7 to position 8. FIG. 23 shows the bolt slanted by rotation of the manual switch 70 placed in its position T Spring 63 causes the bolt to come back to its vertical position.

Figure 24:
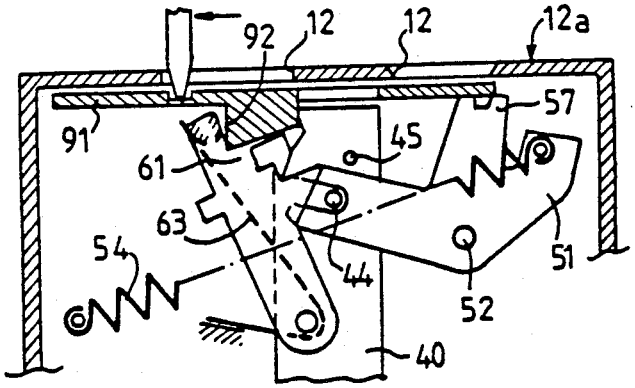
FIGS. 24, 25 show a variant of construction of the auxiliary closure piece.
Figure 25:
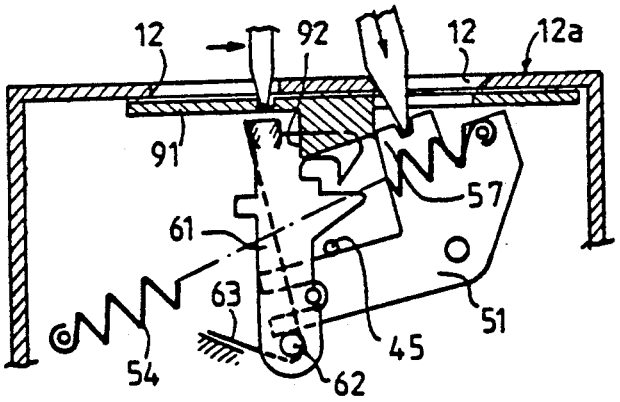

In the variant shown in FIGS. 24, 25, the "contactor-remote controlled breaker" mode switch is a slider 91 movable manually or by a tool through an opening 12*e* from a position in which it makes the bolt 61 inactive (figure 24) by bearing on a heel 92 of the bolt to a position in which it allows bolt 61 to operate (FIG. 25). In addition, the pivoting lever 51 has a projection 57 with a slit in which a tool may be engaged after passing through an opening 12*f* for causing manual closure (or in some cases opening) of the contacts.

The invention has been described for a breaker apparatus with contactor function. It is of course applicable to any apparatus of the contactor kind, with monostable electromagnet.

What is claimed is:

1. A circuit breaker with remote control, said circuit breaker comprising:

(i) a movable contact support supporting at least one movable contact and is mounted for translation in a first direction;

(ii) at least one fixed contact cooperating with said movable contact;

(iii) remotely controlled electromagnet means comprising an electromagnet having a coil, a fixed magnetic circuit and a mobile armature, said remotely controlled electromagnet means further comprising first energizing means for supplying to the coil an energizing current which attracts the armature into engagement with the fixed magnetic circuit and maintains the engagement of the armature with the fixed magnetic circuit, second energizing means for supplying to the coil pulses of current each of which attracts the armature into engagement with the fixed magnetic circuit without maintaining the engagement and switch control means having a first condition in which the coil is connected to the first energizing means and a second condition in which the coil is connected to the second energizing means;

(iv) a movable assembly mounted for translation parallel to said direction from a first position to a second and a third positions, said movable assembly cooperating with said movable contact to engage the movable contact with the fixed contact in the first position of said movable assembly and disengage the movable contact from the fixed contact in a second position of said movable assembly;

(v) means coupling said armature to said movable assembly for moving the movable assembly into said third position when the armature is engaged with the fixed magnetic circuit and for moving the movable assembly into its second position when the armature is disengaged from the fixed magnetic circuit;

(vi) locking means for locking the movable assembly into its first position when the latter is displaced from its second to its first position, said locking means being so arranged that the movable assembly is released when it is displaced from its first to its third position;

(vii) biasing means for returning the movable assembly into its second position when the movable assembly is released; and (viii) lock control means for enabling the locking means when the switch control means is in its second condition and for disabling the locking means when the switch control means is in its first condition.

2. A circuit breaker with remote control, said circuit breaker comprising:

(i) a housing having a median plane which defines first and second volume portions within said housing;

(ii) a movable contact support bridge extending at right angles to said plane from a first end portion which supports a first movable contact and is housed in said first volume portion to a second end portion which supports a second movable contact and is housed in said second volume portion, said bridge being mounted for translation in a direction parallel to said plane and for pivoting at said first end portion about an axis parallel to said plane and at right angles to said direction;

(iii) first and second further fixed contacts respectively cooperating with said first and second movable contacts;

(iv) an elongate trip mechanism extending along said median plane and having an operating condition in which it cooperates with said bridge to disengage the movable contacts from the respective further contacts;

(v) means including current fault responsive trip means, coupled to said trip mechanism, for switching the trip mechanism into the operating condition, said current fault responsive trip means being housed in said first volume portion;

(vi) remotely controlled electromagnet means housed in said second volume portion and comprising an electromagnet of the monostable type having a coil, a fixed magnetic circuit and a mobile armature, said remotely controlled electromagnetic means further comprising first energizing means for supplying to the coil an energizing current which attracts the armature into engagement with the fixed magnetic circuit and maintains the engagement of the armature with the fixed magnetic circuit, second energizing means for supplying to the coil pulses of current each of which attracts the armature into engagement with the fixed magnetic circuit without maintaining with the fixed magnetic circuit without maintaining the engagement and switch control means having a first condition in which the coil is connected to the first energizing means and a second condition in which the coil is connected to the second energizing means;

(vii) a slider housed in said second volume portion and mounted for translation in a direction parallel to said median plane from a first position to a second and a third positions, said slider cooperating with said contact bridge to pivot said bridge and engage the second movable contact with the second fixed contact in the first position of said slider and disengage the second movable contact from the second fixed contact in a second position of said slider;

(viii) lever means coupling said armature to said slider for moving the slider into said third position when the armature is engaged with the fixed magnetic circuit and for moving the slider into its second position when the armature is disengaged from the fixed magnetic circuit;

(ix) locking means for locking the slider into its first position when the latter is displaced from its second to its first position, said locking means being so arranged that the slider is released when it is displaced from its first to its third position;

(x) biasing means for returning the slider into its second position when the slider is released; and (xi) lock control means for enabling the locking means when the switch control means is in its second condition and for disabling the locking means when the switch control means is in its first condition.

3. A circuit breaker as claimed in claim 2, wherein said locking means comprises a bolt mounted for pivoting about a pivot having an axis at right angles to said direction and a spring in said bolt in rotation about said axis and said slider has an engagement pin which cooperates with said bolt.

4. A circuit breaker as claimed in claim 3, wherein said bolt is further mounted for pivoting in a plane containing said axis.

5. A circuit breaker as claimed in claim 3, wherein said lock control means is a rotary piece provided with a cam adapted for causing said bolt to pivot in a plane containing said axis.

6. A circuit breaker as claimed in claim 3, wherein said lock control means is a sliding piece provided with with a heel adapted for causing said bolt to pivot about said axis.

7. A circuit breaker as claimed in claim 3, wherein said biasing means has a pivoting lever urged by a spring and engaged with a surface portion of said slider, said biasing means being adapted for transmitting to the slider a force which decreases during attraction of the armature of the electromagnet towards its position of engagement with the fixed magnetic circuit.

8. A circuit breaker as claimed in claim 9, said circuit breaker further comprising one closure piece which cooperates with said pivoting lever of the biasing means and moves between an inactive position in which it releases said pivoting lever and an active position in which it locks said pivoting lever.

9. A circuit breaker as claimed in claim 8, wherein said pivoting lever of the biasing means is held locked by the direct application of a bearing surface of the pivoting lever under the effect of the spring of the biasing means.

10. A circuit breaker as claimed in claim 8, wherein said auxiliary closure piece is urged by an auxiliary return spring towards its inactive position.

11. A circuit breaker as claimed in claim 10, wherein said auxiliary closure piece has a manual grip with a cursor movable for housing in a step formed in an opening of the housing.

* * * * *